US008167678B2

(12) United States Patent
Castellano

(10) Patent No.: US 8,167,678 B2
(45) Date of Patent: May 1, 2012

(54) BRA CUP FOR AUGMENTING BREASTS AND BRASSIERE HAVING THE SAME

(75) Inventor: Steven Castellano, Middletown, NJ (US)

(73) Assignee: Maidenform, Inc., Iselin, NJ (US)

( * ) Notice: Subject to any disclaimer, the term of this patent is extended or adjusted under 35 U.S.C. 154(b) by 577 days.

(21) Appl. No.: 12/397,885

(22) Filed: Mar. 4, 2009

(65) Prior Publication Data

US 2010/0041313 A1 Feb. 18, 2010

Related U.S. Application Data

(60) Provisional application No. 61/088,890, filed on Aug. 14, 2008, provisional application No. 61/189,526, filed on Aug. 20, 2008.

(51) Int. Cl.
*A41C 3/00* (2006.01)

(52) U.S. Cl. ..... 450/57; 450/54; 450/39

(58) Field of Classification Search ..... 450/36–39, 450/54–57; 2/267, 268; 623/7, 8
See application file for complete search history.

(56) References Cited

U.S. PATENT DOCUMENTS

| | | | | |
|---|---|---|---|---|
| 2,834,352 | A * | 5/1958 | Ullian | 450/57 |
| 3,384,091 | A * | 5/1968 | Block | 450/54 |
| 3,566,878 | A | 3/1971 | Radomski | |
| 3,595,243 | A | 7/1971 | Mount | |
| 3,834,397 | A | 9/1974 | Birch | |
| 5,098,330 | A | 3/1992 | Greenberg | |

(Continued)

FOREIGN PATENT DOCUMENTS

| | | |
|---|---|---|
| DE | 1112022 | 8/1961 |

(Continued)

OTHER PUBLICATIONS

"Womens Playtex Thank Goodness It Fits Seamless Stretch Foam Soft Cup Bra 4406" by Playtex; http://shopping.msn.com/reviews/womens-playtex-thank-goodness-it-fits-seamless-stetch-foam-soft-cup-bra-4406/itemid891615525/?i . . . ; Mar. 10, 2009.

(Continued)

*Primary Examiner* — Gloria Hale
(74) *Attorney, Agent, or Firm* — Dickstein Shapiro LLP

(57) ABSTRACT

A bra cup that supports and augments different areas of the breast. The bra cup includes different sections having different combinations of multilayer fabric and foam materials to create a round, smooth, silhouette underneath the clothing of the wearer without sacrificing the comfort of the wearer or the accuracy of the fit. The bra cup includes two or more discrete sections that are attached together and then covered on an outward facing surface with a continuous foam and fabric layer that provides a smooth outer surface. The first section includes a stabilizer material that creates a sling-like mechanism that causes the first section to cradle the breasts of a wearer, while pushing the breasts simultaneously upwards towards the neckline and inwards towards the other breast. The second section includes an area of increased thickness in a location corresponding to the superior lateral quadrant of the breast. The combination of the stabilizer in the first section and the area of thicker cross section in the second section cooperate to create a rounded overall appearance to the breasts of the wearer. The addition of the continuous foam layer and laminated fabric layer cooperate with the first and second sections in the bra cup to create a round and smooth silhouette underneath the clothing of the wearer.

18 Claims, 5 Drawing Sheets

U.S. PATENT DOCUMENTS

| | | | | |
|---|---|---|---|---|
| 6,101,630 | A * | 8/2000 | Lee | 2/57 |
| 6,824,444 | B2 * | 11/2004 | Huang | 450/57 |
| 6,878,033 | B2 | 4/2005 | Luk | |
| 6,918,812 | B2 | 7/2005 | Giese | |
| 7,074,108 | B2 * | 7/2006 | Knox | 450/1 |
| 7,204,741 | B2 | 4/2007 | Giese | |
| 7,244,167 | B2 * | 7/2007 | Falla | 450/54 |
| 7,922,560 | B2 * | 4/2011 | Avalos-Dessner et al. | 450/39 |
| 2004/0147203 | A1 * | 7/2004 | Luk | 450/39 |
| 2006/0025041 | A1 * | 2/2006 | Falla et al. | 450/39 |
| 2006/0052034 | A1 * | 3/2006 | Falla et al. | 450/39 |
| 2006/0094333 | A1 * | 5/2006 | Wood et al. | 450/39 |
| 2009/0247047 | A1 * | 10/2009 | Avalos-Dessner et al. | 450/52 |

FOREIGN PATENT DOCUMENTS

| | | | |
|---|---|---|---|
| JP | 2001-200403 | A | 7/2001 |
| JP | 2003-328209 | A | 11/2003 |
| JP | 2005-290613 | A | 10/2005 |
| JP | 2006-348423 | | 12/2006 |

OTHER PUBLICATIONS

Donna Karan Intimates Solutions Strapless Bra—Women's—Bloomingdales.com; "Donna Karan Intimates Soluctions Strapless Bra"; http://www1.bloomingdales.com/catalog/product/index.ognc?ID=116371&PartnerID=LINKSHARE&LinkshareID=WUqD6wTpSTG- . . . ; Mar. 10, 2009.

* cited by examiner

BRA CUP FOR AUGMENTING BREASTS AND BRASSIERE HAVING THE SAME

CROSS-REFERENCE TO RELATED APPLICATIONS

This application claims the benefit of U.S. Provisional Application No. 61/088,890, filed Aug. 14, 2008, and U.S. Provisional Application No. 61/189,526, filed Aug. 20, 2008.

FIELD OF THE INVENTION

The present invention is directed to a brassiere that shapes the breasts through a combination of support and augmentation. More specifically, the present invention is directed to a brassiere that includes a multi-layer foam bra cup that supports and augments the breasts of the wearer of the brassiere for a more pleasing appearance.

BACKGROUND OF THE INVENTION

Although the natural shape of women's breasts resemble a tear drop, with the more narrow portion on top and the rounder part on the bottom, a shape considered more aesthetically pleasing is a shape that is closer to that of a sphere, consistently round from the top to the bottom of the breast. As women get older, the breasts tend to sag, thus, any roundness that may have existed in the top of the breast is diminished, which further exaggerates the tear drop shape. To this end, different bras have been manufactured to create the illusion of a rounder shape throughout the breast and thus disguise the natural tear drop shape of the breast. One example is a push up bra, wherein padding is added at the bottom of each cup in order to fill up the bottom of the cup and push the breasts upward. By gathering the majority of the breast tissue towards the top of the cup, the top of the breasts can appear more round.

One problem with using padding at the bottom of the bra to prop up the breasts is that the breasts can overflow the cup, which will not create a smooth, round, silhouette underneath clothing. If a clothing item being worn by an individual is higher cut than the bra, the bra cup can create an indentation in the breast that is visible underneath the clothing of the wearer.

Another problem with using padding at the bottom of a bra cup to elevate the breasts is that elevating the breasts in this manner will not necessarily position them in such a way as to fill out the top of the cup and create a round shape. The shape created at the top of the cup will be dependent upon the individual shape of the breast that is being elevated. Thus, the illusion of roundness created by the bra will vary depending upon the breasts of the wearer.

In attempts to address the issue of providing a uniform shape to the breasts, brassiere manufacturers have proposed a brassiere having molded foam cups. Although suitable for many purposes, one of the main drawbacks to a molded foam bra cup is that the generally inflexible molded foam provides a less exact fit for the wearer. Additionally, the comfort of the wearer is sometimes sacrificed because the foam does not fully conform to the tear-drop shaped breasts of the wearer. Accordingly, such a molded foam bra cup does not always provide a natural look for the wearer.

SUMMARY OF THE INVENTION

There is thus a need for a bra cup that provides different types and degrees of support and augmentation to different areas of the breast. The prior art bra cups have not been successful in achieving an effective combination of support and augmentation to different areas of the breast in a single bra cup. The presently preferred embodiment of the invention achieves this desired combination of support and augmentation to different areas of the breast by providing a bra cup with different sections having different combinations of multilayer fabric and foam materials.

The presently preferred embodiment of the bra cup of the invention creates a round, smooth, silhouette underneath the clothing of the wearer without sacrificing the comfort of the wearer or the accuracy of the fit. The bra cup elevates the breasts, while padding the cup in certain targeted areas to augment the breast creates the illusion of a rounder breast and disguises the natural tear drop shape. Thus, the fit of the cup is not sacrificed, while at the same time the shape of the breast appears rounder at the top. Despite the additional material that enhances the shape of the breast, the bra cup of the present invention flexibly conforms to the shape of the wearer.

The presently preferred embodiment of the bra cup of the invention includes two or more discrete sections that are ultrasonically welded together and then covered on an outward facing surface with a continuous foam and laminated fabric that provides a smooth outer surface. The first section includes a stabilizer material that creates a sling-like mechanism that causes the first section to cradle the breasts of a wearer, while pushing the breasts simultaneously upwards towards the neckline and inwards towards the other breast. The second section includes an area of increased thickness in a location corresponding to the superior lateral quadrant of the breast (i.e., the portion of the breast that extends diagonally upwards towards the axillae or armpit).

The action of the first section on the breast causes the breast of the wearer to move toward the second section of the bra cup and provides the breast with a rounder appearance on the top, which is generally where the narrowest part of a tear drop shape breast exists. Because a tear drop shaped breast generally does not have a significant amount of breast tissue in the superior lateral quadrant of the breast, the area of thicker cross section in the second section fills this area to further augment the upper portion of the breasts, thereby allowing this portion of the breast to appear consistently rounded atop.

Accordingly, the combination of the stabilizer in the first section and the area of thicker cross section in the second section cooperate to create a rounded overall appearance to the breasts of the wearer. The addition of the continuous foam layer and laminated fabric layer cooperate with the first and second sections in the bra cup to create a round and smooth silhouette underneath the clothing of the wearer.

The first and second sections can also have different stretch characteristics so as to provide a bra cup with a more customized fit. Specifically, each of the first and second sections can have different degrees of stretch in one or multiple directions. It is preferred that the section closest to the cleavage of the wearer have the greatest degree of stretch so that the breast of the wearer does not jut out of the bra cup and ruin the line of the bra cup due to the upward and inward pushing of the breast by the first section. Providing the sections of the bra cup with different stretch characteristics allows the bra cup to better accommodate different contours of a breast within a certain size breast cup (i.e., a "B" size cup), and also allows the bra cup to conform more naturally and comfortably with a wearer's breasts.

In addition, the relative thickness of the foam layers can be altered to assist in hiding the wearer's nipples. For example, to maintain a consistent look of the bra cup, the foam layers of the second section can be made thicker in portions corresponding to locations of the wearer's nipples.

Since women with smaller breasts may not have enough breast tissue for the first section to push upwards and inwards, the desired rounded shape of the breast at the top portion of the bra cup may not be created. Accordingly, in a second presently preferred embodiment of a bra cup according to the invention, the bra cup is provided with a second area of increased thickness in the first section, as well as the area of increased thickness in the second section. The second area of increased thickness in the first section provides assistance in augmenting smaller sized breasts by providing more material in the first section to push against the breast of the wearer.

BRIEF DESCRIPTION OF THE DRAWINGS

The figures are for illustration purposes only and are not necessarily drawn to scale. The invention itself, however, may best be understood by reference to the detailed description which follows when taken in conjunction with the accompanying drawings in which.

DETAILED DESCRIPTION OF THE INVENTION

The present invention will next be illustrated with reference to the figures. Such figures are intended to be illustrative rather than limiting and are included herewith to facilitate the explanation of exemplary features of embodiments of the present invention. Unless otherwise noted, the figures are not to scale, and are not intended to serve as engineering drawings.

Figure 1:
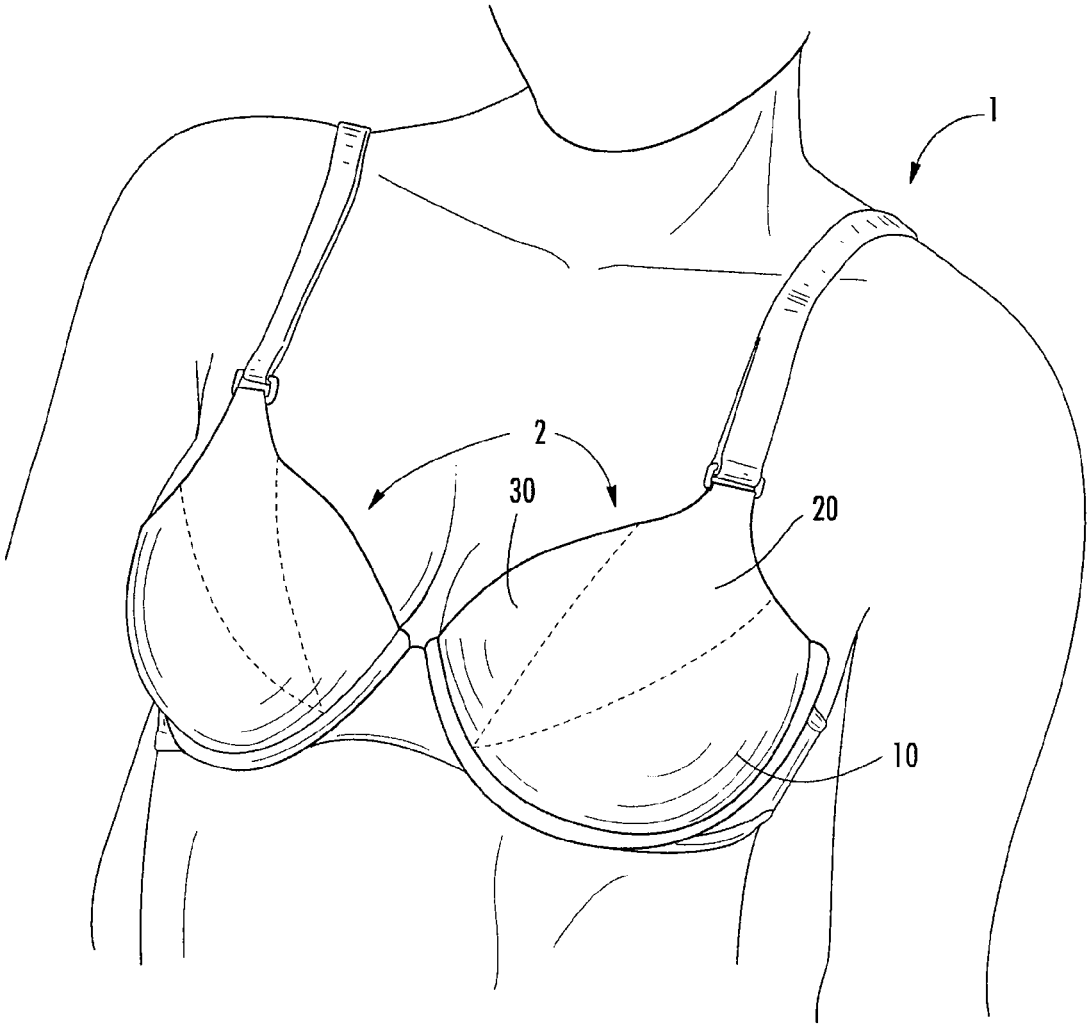
FIG. 1 is a perspective view of a first embodiment of a brassiere having a bra cup of the present invention secured about the torso of a wearer.

Referring now to the drawings wherein like numerals indicate like elements, a first embodiment of a brassiere having a bra cup constructed in accordance with the principles of the present invention, and designated generally as bra cup 2, is shown in FIGS. 1-4. FIG. 1 shows the brassiere 1 secured around the torso of a wearer. The bra cups 2 of the brassiere 1 include a first section 10, a second section 20, and a third section 30. Although the presently preferred embodiments are described as having three sections, the bra cup of the present invention can be formed using more than three or less than three sections to achieve the desired combination of support and augmentation for any particular size and shape breast. The brassiere 1 is also shown as including shoulder straps and wings to assist in securing the brassiere around the torso of a wearer. It will be evident to one of skill in the art that various brassiere configurations, such as strapless, rear hook and front hook, can incorporate the bra cups 2 of the present invention.

Figure 2:
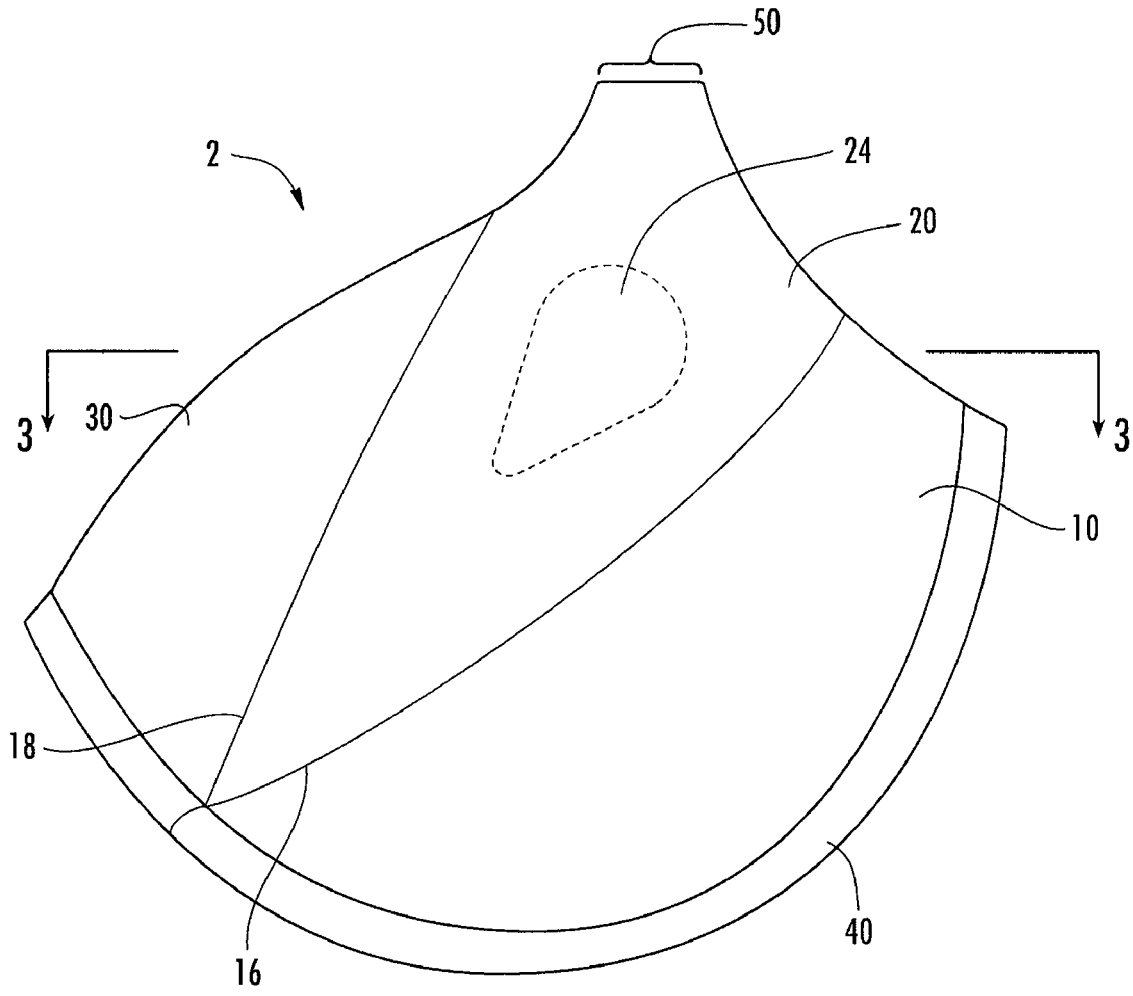
FIG. 2 is a plan view of the inside surface of the bra cup shown in FIG. 1.

FIG. 2 is a view of the inner surface of a single bra cup 2 shown in FIG. 1. The first section 10 is the bottommost portion of the bra cup 2 and juxtaposes the underside of the breast of the wearer. The first section 10 preferably includes a flange 40 which preferably extends along the entire lower edge of the bra cup 2 and is designed to rest against torso of the wearer underneath the breast and provide support thereto. In certain embodiments of the bra cup of the present invention configured for larger breasted women, the flange 40 will incorporate an underwire (not shown) for additional support of the breast.

Figure 3:
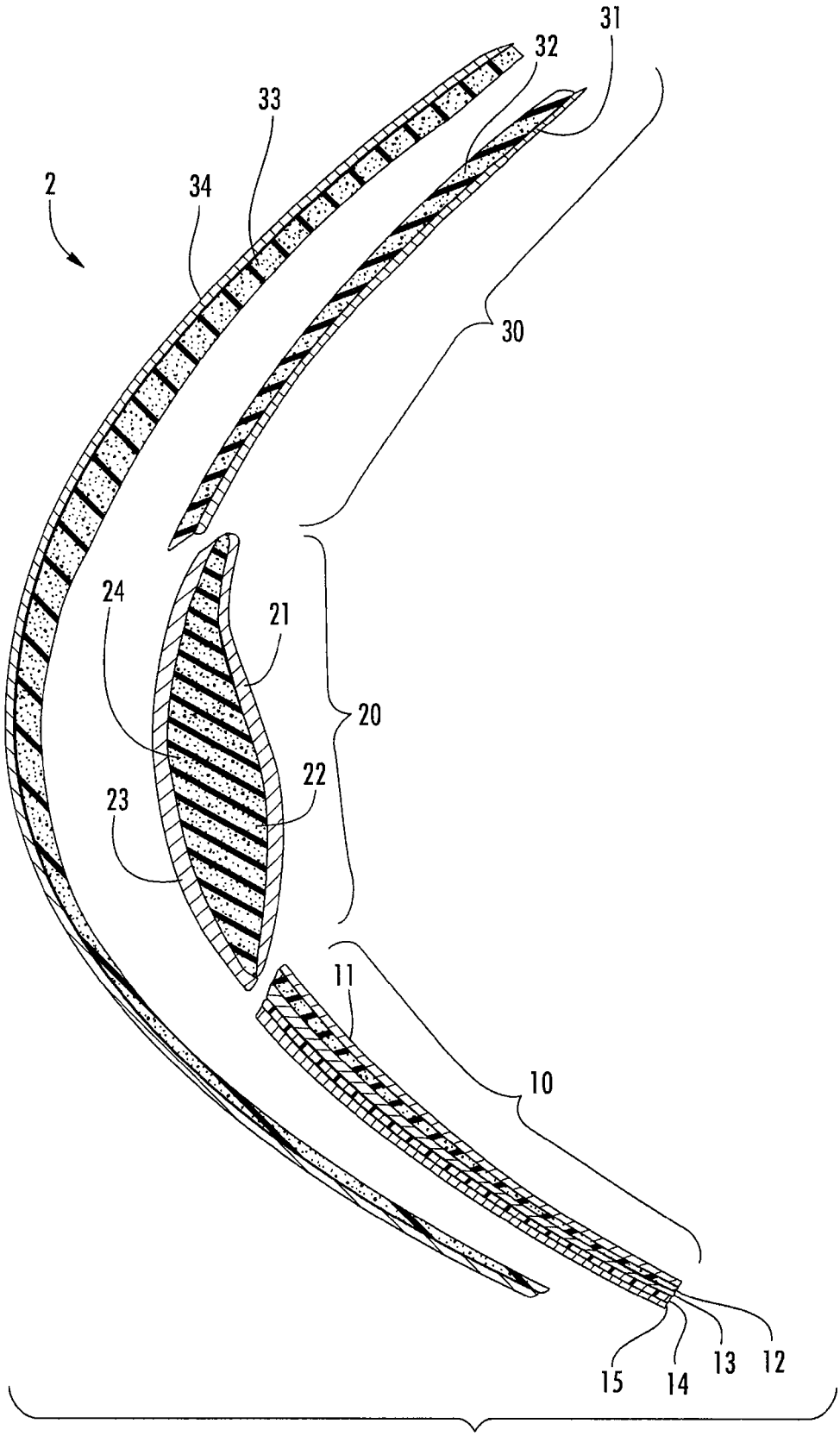
FIG. 3 is an exploded cross-sectional view of the bra cup of FIG. 1 along line 3-3.
Figure 4:
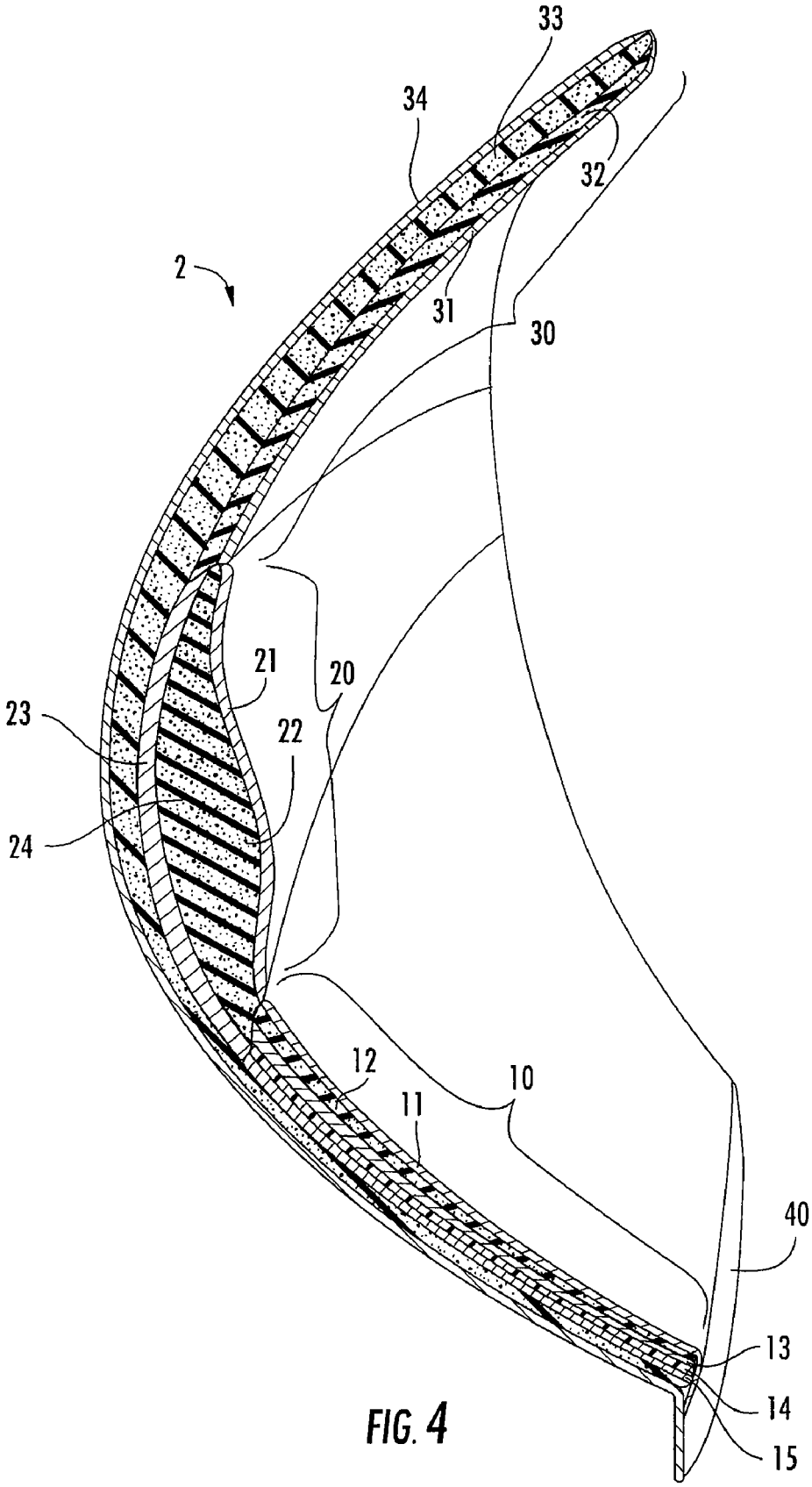
FIG. 4 is a cross-sectional view of the bra cup of FIG. 1 along line 3-3.

As shown in FIG. 3, which is an exploded assembly view in cross-section along line 3-3 of FIG. 2, the first section 10 of the bra cup 2 comprises multiple layers of material joined together. In the presently preferred embodiment as shown in FIG. 3, the first section 10 includes a first foam layer 12 having a fabric 11 attached thereto, a second foam layer 13, a stabilizer 14, and a third foam layer 15. The various layers of the first section 10 are preferably laminated to each other using a heat activated resin or an adhesive. The foam material used in the bra cup of the present invention is preferably polyester, but may be any other foam that is suitable for bra construction, including but not limited to fiberfill and memory foam.

The stabilizer 14 is comprised of a material that imparts rigidity to the first section 10 and spans the entire width and height of the first section 10. The stabilizer 14 is preferably selected from mesh, stabilized tricot, inflexible films such as polyurethane, rubber or latex, microfiber fabric, high density foams such as polyether or polyester, pindot fabric, thermoplastic films, and mesh or web adhesives. The specific material chosen for the stabilizer will depend on for example, the degree of support required for the particular bra cup size being designed as well as the overall size of the brassiere. As explained in more detail below, the stabilizer 14 provides support to the breast of the wearer than the other sections of the bra cup, thereby creating a sling-like mechanism that cradles the breast of the wearer, while pushing the breast of the wearer upwards towards the neckline and simultaneously inwards towards the other breast. The interaction of the first section 10 with the other portions of the brassier will be described in greater detail below.

Returning to FIG. 2, the second section 20 of the bra cup 2 is attached to the first section 10 along a joining edge 16. The second section 20 is preferably configured to span a portion of the bra cup 2 corresponding to the wearer's nipple. The second section 20 is preferably shaped so as to include a platform 50 to which an optional bra strap (as shown in FIG. 1) is attached. It will be readily evident to one of skill in the art that the second section will be shaped without a platform if the brassiere is to be strapless.

The second section 20 of the bra cup 2 also comprises multiple layers of material joined together. In the presently preferred embodiment as shown in FIG. 3, the second section 20 includes a first foam layer 22 having a fabric 21 attached thereto, and a second foam layer 23. The various layers of the second section 20 are preferably laminated to each other using a heat activated resin or an adhesive similar to that of the layers of the first layer 10.

As shown by dotted lines in FIG. 2, one of the foam layers of the second section 20 has an area of thicker cross section 24 (see FIG. 3). In the presently preferred embodiment shown in FIG. 3, the area of thicker cross section 24 is provided in foam layer 22. The area of thicker cross section could also be provided in foam layer 23. The area of thicker cross section 24 is preferably positioned in the second section 20 so as to juxtapose the superior lateral quadrant of the breast (i.e., the portion of the breast that extends diagonally upwards towards the axillae or armpit). The area of thicker cross section 24 is preferably formed so as to create a convex shape on the concave inner surface of the bra cup, and not on the outer surface of the bra cup (see FIG. 4). In the embodiment shown in FIGS. 1-4, the area of thicker cross section 24 is proximal to the platform 50.

The area of thicker cross section 24 is preferably formed integrally with either of foam layers 22 or 23. For example, the area of thicker cross section 24 is preferably formed in foam layers 22 or 23 by adjusting the manufacturing parameters of the foam, such as temperature, pressure and dwell time, to create the area of thicker cross section than the remainder of the foam layers 22 or 23. It should also be noted that, while FIG. 3 shows the area of thicker cross section 24 as formed integrally with foam layer 22, the area of thicker cross section can be provided by way of a separate piece of material, such as foam, plastic, or a liquid or air-filled pouch, positioned between foam layers 22 and 23. The interaction of the area of thicker cross section 24 with other components of the bra cup 2 will be described in greater detail below.

Returning to FIG. 2, the third section 30 of the bra cup 2 is attached to the second section 20 along a joining edge 18. The third section 30 is preferably positioned so as to be proximal to the cleavage area of the wearer's breast. In the presently preferred embodiment shown in FIGS. 1 and 2, the third section 30 also forms part of the flange 40.

The third section 30 of the bra cup 2 also comprises multiple layers of material joined together. In the presently preferred embodiment as shown in FIG. 3, the third section 30 includes a first foam layer 32 having a fabric 31 attached thereto. The various layers of the third section 30 are also preferably laminated to each other using a heat activated resin or an adhesive similar to that of the layers of the first layer 10 and second layer 20.

The three sections 10, 20 and 30 are covered by a continuous layer of foam 33 having a fabric 34 attached thereto, preferably by lamination. This continuous layer of foam 33 and attached fabric 34 provides a smooth overall outer appearance to the bra cup 2, which in turn creates a clean line underneath the clothing of a wearer. The continuous layer of foam 33 and attached fabric 34 also provides structural integrity to the bra cup 2 by retaining the first, second, and third sections 10, 20, 30 in their respective locations.

A preferred method of manufacturing the bra cup 2 of the present invention will now be described. Preferably, the foam 12 and fabric 11 layers of the first section 10, the foam 22 and fabric 21 layers of the second section 20, and the foam 32 and fabric 31 layers of the third section 30 are cut to the desired shape and ultrasonically welded together along their respective joining edges 16 and 18. The ultrasonic welding creates smooth seam at respective joining edges 16 and 18 along the inside portion of the bra cup 2 for a comfortable feel against the skin of a wearer. These respective sections, however, may also be joined by sewing, gluing, or any other method that is known to one of ordinary skill in the bra making art. The particular shape of each of the first, second, and third sections 10, 20, 30, determines the overall shape and size of the bra cup 2 when the respective sections are joined together.

Next, the other components of the first section 10, i.e., the second foam layer 13, the stabilizer 14, and the third foam layer 15, are respectively joined together, preferably by lamination using a heat-activated resin. Likewise, the second foam layer 23 is joined to the foam 22 and fabric 21 of the second section 20 preferably using a heat-activated resin. In the embodiment shown in FIG. 3, the third section 30 does not have any additional layers other than the first foam layer 32 and fabric 31.

Separately from the first, second and third sections 10, 20, 30, the continuous layer of foam 33 and attached fabric 34 is formed. Then, the continuous layer of foam 33 and fabric 34 is joined to the welded first, second and third sections 10, 20, 30, preferably by lamination, to form the bra cup 2 including the flange 40 as shown in the cross section of FIG. 4. As noted above, the continuous layer of foam 33 and fabric 34 reinforces the welded seams between the first, second and third sections 10, 20, 30, provides general stability to the bra cup 2, and provides a smooth aesthetic appearance on the outside of the bra cup 2, thereby creating a clean line underneath the clothing of a wearer. The bra cup 2 is then incorporated into a brassiere 1 as shown in FIG. 1.

When the thus assembled brassiere 1 having the bra cup 2 of the present invention is placed about the torso of a wearer, the stabilizer material 14 of the first section 10 creates a sling-like mechanism that causes the first section 10 to cradle the breasts of a wearer, while pushing the breasts simultaneously upwards towards the neckline and inwards towards the other breast. The action of the first section 10 on the breast causes the breast of the wearer to move toward the second and third sections 20, 30 of the bra cup 2 and provides the breast with a rounder appearance on the top, which is generally where the narrowest part of a tear drop shape breast exists. Because a tear drop shaped breast generally does not have a significant amount of breast tissue in the superior lateral quadrant of the breast (i.e., the portion of the breast that extends diagonally upwards towards the axillae or armpit), the area of thicker cross section 24 in the second section 20 is provided to fill-in this area to further augment the upper portion of the breasts, thereby allowing this portion to appear consistently rounded atop. As shown in FIG. 2, the area of thicker cross section 24 has a teardrop shape. The area of thicker cross section 24, however, can be other shapes as well, such as round, oval, or any other desired shape. As will be evident to one of skill in the art from the above description of the purpose of the area of thicker cross section 24, the shape thereof will be dependent on the characteristics of the breast being shaped by the bra cup.

Accordingly, the combination of the stabilizer 14 in the first section and the area of thicker cross section 24 in the second section 20 cooperate to create a rounded overall appearance to the breasts of the wearer. The addition of the continuous foam layer 33 and attached fabric layer 34 cooperate with the first, second and third sections 10, 20, 30 in the bra cup to create a round and smooth silhouette underneath the clothing of the wearer.

Moreover, in the presently preferred embodiment of the invention, the layers comprising the first, second and third sections 10, 20, 30 have different stretch characteristics so as to provide a bra cup with a more customized fit. Specifically, each of the first, second and third sections 10, 20, 30 can have different degrees of stretch in one or multiple directions. For example, in the embodiment of FIGS. 1-4, the first section 10 has the least degree of stretch because of the presence of the stabilizer 14, which renders the entire section 10 relatively inelastic; the second section 20 has a greater degree of stretch than the first section 10; and the third section 30 has a greater degree of stretch than the first section 10 and the second section 20. It is preferred that the third section 30 have the greatest degree of stretch so that the breast of the wearer does not jut out of the bra cup and ruin the line of the bra cup due to the upward and inward pushing of the breast by the first section 10. Providing the first, second and third sections 10, 20, 30 with different stretch characteristics allows the bra cup 2 to better accommodate different contours of a breast within a certain size breast cup (i.e., a "B" size cup), and also allows the bra cup 2 to conform more naturally and comfortably with a wearer's breasts.

It should be noted that although the number of layers of material vary in each of the first, second and third sections 10, 20, 30 of the presently preferred embodiment described herein, the actual number of layers in each section may further vary based on specific requirements of the bra cup being constructed for a particular breast size and shape. For example, it may be desirable to use more foam layers for smaller sized breast cups to provide the appearance of larger breasts for the wearer. Accordingly, the number of layers of material shown in the presently preferred embodiment of FIGS. 1-4 is merely illustrative and in no way excludes other combinations of layers that may be employed by one of ordinary skill in the art to achieve the benefits of the present invention.

In addition, the relative thickness of the foam layers can be altered to assist in hiding the wearer's nipples. For example, to maintain a consistent look of the bra cup 2, the foam layers of the second section 20 can be made thicker in portions corresponding to locations of the wearer's nipples. This can be accomplished in the same manner as that of providing the area of increased thickness 24 in the second section 20 noted above.

Figure 5:
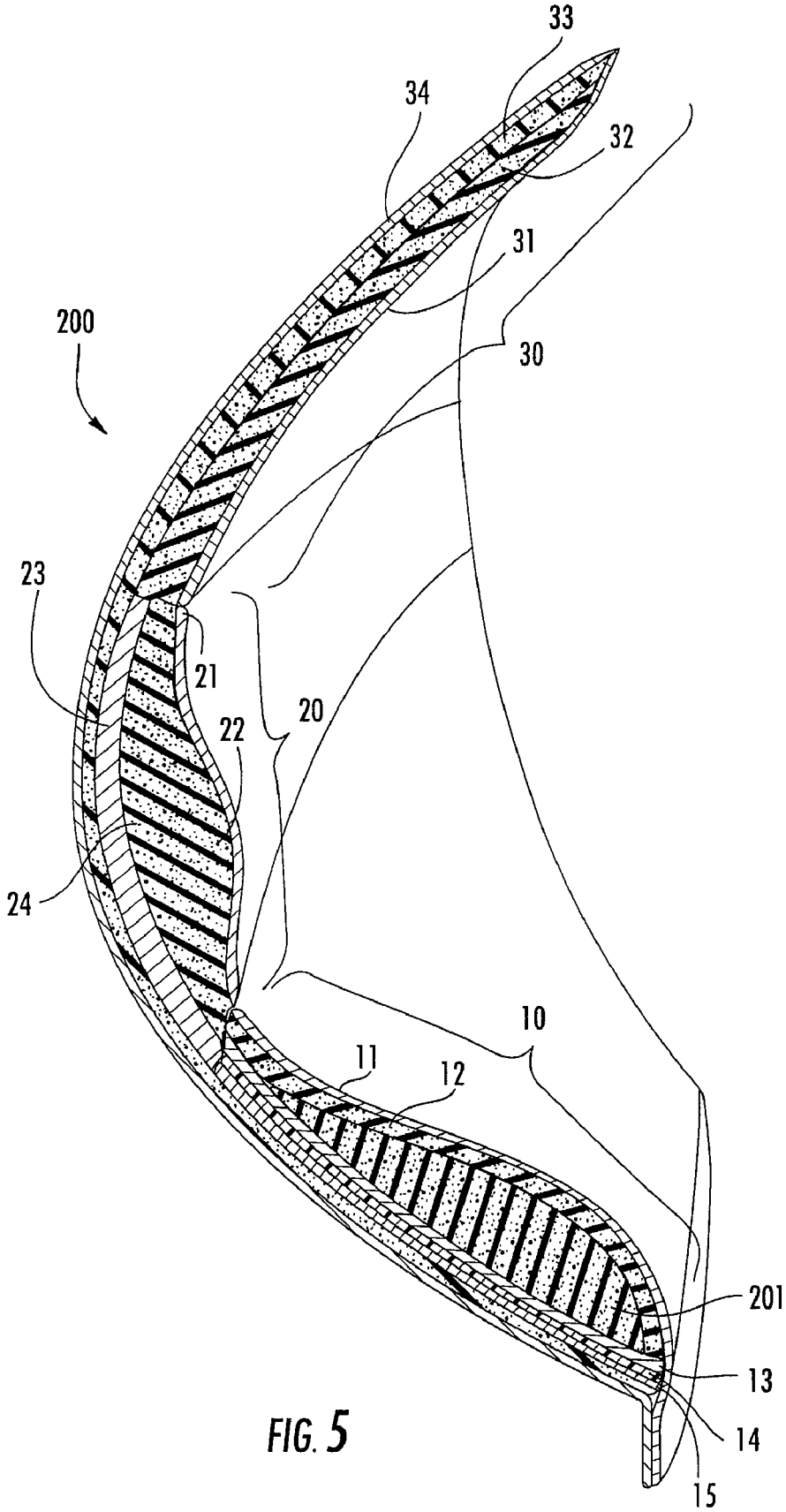
FIG. 5 is a cross-sectional view of a second embodiment of the bra cup of the present invention.

Referring now to FIG. 5, a cross-sectional view of a second embodiment of a bra cup 200 according to the present invention is shown. Similar to the first embodiment of FIGS. 1-4, the second embodiment includes first, second and third sections 10, 20, 30. In the bra cup 200 of the second embodiment, a second area of increased thickness 201 is provided in the first section 10 in addition to the area of increased thickness 24 in the second section 20.

For a woman with smaller breasts, the first section 10 may not be sufficient to create the desired rounded shape of the breast at the top portion of the bra cup 200 because there is not enough breast tissue to push upwards and inwards to create the desired rounded look. Thus, the use of the second area of increased thickness 201 in the first section 10 provides assistance in augmenting smaller sized breasts. The second area of increased thickness 201 in the first section 10 can be formed similar to that of the area of increased thickness 24 in the second section 20 as described above.

Although the present invention has been described in relation to particular embodiments thereof, many other variations and modifications will become apparent to those skilled in the art. For example, depending on the size and shape of the breast, the bra cup of the present invention can be formed using more or fewer sections than those used in the presently preferred embodiments described herein. As such, it will be readily evident to one of skill in the art based on the detailed description of the presently preferred embodiments of the bra cup explained herein, that different support and augmentation characteristics can also be realized by varying the number of layers, the particular materials chosen for those layers, the specific shape of the sections, the number of sections, etc. Therefore, the present invention should not be limited by the specific disclosure herein, but only by the appended claims.

I claim:

1. A bra cup comprising:

a plurality of sections, at least two sections of the plurality of sections having a plurality of layers, at least a first layer of each of the at least two sections being a non-foam material, and at least a second layer of each of the at least two sections being a foam material, a first combination of the plurality of layers in a first section of the at least two sections being different from a second combination of the plurality of layers in a second section of the at least two sections such that each of the first and second sections have different support and augmentation characteristics, wherein the first section of the plurality of sections is configured to juxtapose a lower portion of a wearer's breast and includes a stabilizer material which has a stretch characteristic which is substantially more supportive than that of materials of other sections of the plurality of sections, and wherein at least a portion of the second section has an area of increased thickness corresponding to a superior lateral quadrant of the wearer's breast.

2. The bra cup according to claim 1, further comprising a continuous layer of material extending over each of the plurality of sections on an outer surface of the bra cup so as to provide a smooth outer surface.

3. The bra cup according to claim 2, wherein the continuous layer of material is laminated over each of the plurality of sections.

4. The bra cup according to claim 1, wherein the plurality of sections are joined together by an ultrasonic weld.

5. The bra cup according to claim 1, wherein the plurality of sections is three sections.

6. A bra cup comprising:

a first section configured to juxtapose a lower portion of a wearer's breast, the first section including at least one foam layer, a stabilizer material and a fabric layer, the fabric layer defining an inner surface of the first section;

a second section adjacent the first section, the second section including at least one foam layer and a fabric layer, the fabric layer defining an inner surface of the second section, and at least a portion of the second section having an area of increased thickness corresponding to a superior lateral quadrant of the wearer's breast; and a continuous fabric layer extending over outer surfaces of both the first and second sections, wherein wherein the first and second sections have different support and augmentation characteristics from each other.

7. The bra cup according to claim 6, wherein the stabilizer material has a stretch characteristic which is substantially more supportive than that of the foam and fabric layers of the first and second sections.

8. The bra cup according to claim 6, wherein the first and second sections are joined together by an ultrasonic weld.

9. The bra cup according to claim 6, further comprising a third section adjacent the second section, the third section including at least one foam layer and a fabric layer, the fabric layer defining an inner surface of the third section.

10. The bra cup according to claim 9, wherein the second and third sections are joined by an ultrasonic weld.

11. The bra cup according to claim 9, wherein the continuous fabric layer also extends over an outer surface of the third section.

12. A bra cup comprising:

a first foam section;

a second foam section attached to the first foam section, at least a portion of the second foam section having an area of increased thickness corresponding to a superior lateral quadrant of the wearer's breast; and a third foam section attached to the second foam section and configured to juxtapose a lower portion of a wearer's breast, the third foam section including a stabilizer material that minimizes a degree of stretch of the third foam section in all directions.

13. The bra cup according to claim 12, wherein at least a portion of the third section has an area of increased thickness that is adapted to impart a rounding effect to the bra cup.

14. The bra cup according to claim 12, wherein the stabilizer material in the third section that minimizes the degree of stretch of the third section is positioned to push a breast of a wearer simultaneously inward and upward directions.

15. The bra cup according to claim 12, further comprising a continuous layer of material extending over each of the first, second and third sections on an outer surface of the bra cup so as to provide a smooth outer surface.

16. A brassiere comprising:

first and second bra cups, at least one of the first and second bra cups comprising the bra cup according to claim 1.

17. The brassiere according to claim 16, further comprising at least one bra wing attached to each of the first and second bra cups.

18. The brassiere according to claim 17, further comprising at least one bra strap attached to each of the first and second bra cups.

* * * * *